US010539392B2

(12) United States Patent
Schweyen

(10) Patent No.: US 10,539,392 B2
(45) Date of Patent: Jan. 21, 2020

(54) DEVICES, SYSTEMS AND METHODS FOR SIGHTING

(71) Applicant: Brian Schweyen, Missoula, MT (US)

(72) Inventor: Brian Schweyen, Missoula, MT (US)

( * ) Notice: Subject to any disclaimer, the term of this patent is extended or adjusted under 35 U.S.C. 154(b) by 0 days.

(21) Appl. No.: 16/211,294

(22) Filed: Dec. 6, 2018

(65) Prior Publication Data

US 2019/0113309 A1 Apr. 18, 2019

Related U.S. Application Data

(63) Continuation of application No. 15/152,331, filed on May 11, 2016, now Pat. No. 10,151,563.

(60) Provisional application No. 62/159,748, filed on May 11, 2015.

(51) Int. Cl.
*F41G 1/467* (2006.01)

(52) U.S. Cl.
CPC ..... *F41G 1/467* (2013.01)

(58) Field of Classification Search
CPC ..... F41G 1/467
USPC ..... 124/87; 33/265
See application file for complete search history.

(56) References Cited

U.S. PATENT DOCUMENTS 3,136,063 A * 6/1964 Stebbins ..... F41G 1/467 124/87
3,670,422 A * 6/1972 Stebbins ..... F41G 1/467 33/265
4,796,364 A * 1/1989 Amacker ..... F41G 1/467 33/265
4,953,302 A * 9/1990 Gould ..... F41G 1/467 124/87
5,253,423 A * 10/1993 Sullivan, Jr. ..... F41G 1/467 124/87
5,421,315 A * 6/1995 Miller ..... F41G 1/467 124/80
5,524,351 A * 6/1996 Pinson ..... F41G 1/467 124/87
6,079,111 A * 6/2000 Williams ..... F41G 1/467 124/87
6,082,012 A * 7/2000 McLeod ..... F41G 1/467 124/87
6,145,208 A * 11/2000 Savage ..... F41G 1/467 124/87
7,243,432 B1 * 7/2007 Rager ..... F41G 1/467 124/87
7,296,358 B1 * 11/2007 Murphy ..... F41G 1/44 33/265
7,581,325 B1 * 9/2009 Willman ..... F41G 1/10 124/87
8,046,927 B1 * 11/2011 Edmundson ..... F41G 1/467 124/87
8,069,577 B1 * 12/2011 Willman ..... F41G 1/467 124/87
8,689,454 B2 * 4/2014 Pulkrabek ..... F41G 1/467 124/87
8,839,525 B2 * 9/2014 Pulkrabek ..... F41G 1/467 124/87

(Continued)

*Primary Examiner* — Alexander R Niconovich
(74) *Attorney, Agent, or Firm* — Davis, Brown, Koehn, Shors & Roberts, P.C.; Matthew Warner-Blankenship

(57) ABSTRACT

The disclosed apparatus, systems and methods relate to improved sighting for sporting goods, such as bows, for use in hunting and target shooting. The sight may have a pendulum level. The sight can be configured to be aimed at the bottom of an animal, and have an adjustable range finder.

20 Claims, 18 Drawing Sheets

(56) References Cited

U.S. PATENT DOCUMENTS

| | | | | |
|---|---|---|---|---|
| 9,103,632 | B1 * | 8/2015 | Larson | F41G 1/467 |
| 9,134,095 | B1 * | 9/2015 | Mills | F41G 1/467 |
| 9,772,165 | B1 * | 9/2017 | Johnson | F41G 1/467 |
| 2005/0132588 | A1 * | 6/2005 | McLeod | F41G 1/467 33/265 |
| 2005/0241163 | A1 * | 11/2005 | Cudney, Jr. | F41G 1/467 33/265 |
| 2005/0246909 | A1 * | 11/2005 | Rager | F41G 1/467 33/265 |
| 2006/0254065 | A1 * | 11/2006 | Grace | F41G 1/467 33/265 |
| 2007/0028467 | A1 * | 2/2007 | Bradley | F41G 1/467 33/265 |
| 2009/0007446 | A1 * | 1/2009 | Humpert | F41G 1/467 33/265 |
| 2010/0115778 | A1 * | 5/2010 | Gorsuch | F41G 1/467 33/265 |
| 2011/0120438 | A1 * | 5/2011 | Samuels | F41G 1/467 124/87 |
| 2011/0271943 | A1 * | 11/2011 | Maynard | F41G 1/467 124/87 |
| 2015/0241172 | A1 * | 8/2015 | Roman | F41G 1/473 235/404 |

* cited by examiner

DEVICES, SYSTEMS AND METHODS FOR SIGHTING

CROSS-REFERENCE TO RELATED APPLICATION(S)

This application claims priority to U.S. patent application Ser. No. 15/152,331 filed May 11, 2016 and entitled "Improved Devices, System and Methods for Sighting" and U.S. Provisional Application No. 62/159,748 filed May 11, 2015 and entitled "Devices, Systems and Methods for Sighting" which is hereby incorporated by reference in its entirety under 35 U.S.C. § 119(e).

TECHNICAL FIELD

The disclosed technology relates generally to sporting equipment for use in hunting, and in particular, to the devices, methods and design principles allowing for the bow hunting of animals with greater accuracy by way of a sight system.

BACKGROUND

One of the most popular outdoor sports is hunting. The disclosure relates generally to sporting equipment, and more specifically a sight for use in bow hunting.

There is a need in the art for improved bow sighting devices, systems and methods.

BRIEF SUMMARY

Discussed herein are various apparatus, systems and methods relating to the use of a bow sight. For brevity, these various embodiments and modalities may be referred to herein as a "sight," or a "sight system," though this is in no way intended to be limiting to a specific modality.

In one Example, a bow sight for aiming at a target with a bow, including a housing including a view finder a leveling bar disposed in the view finder a distance limit bar disposed in the view finder and a pendulum level disposed in the view finder.

Implementations may include one or more of the following features. The bow sight where the leveling bar includes a fiber optic pin sight. The bow sight where the target has a lower aim point and a high kill zone, and the fiber optic pin sight is configured to be aimed at the aim point during use. The bow sight where the distance limit bar is adjustable. The bow sight where the distance limit bar and leveling bar form a range finder in the view finder. The bow sight where the pendulum level includes a sighting end and the housing further includes a leveling member, where the pendulum level is freely rotatable relative to the housing by way of the leveling member, and the sighting end is configured to be disposed substantially adjacent to the pin sight when in the housing is in an upright position. The bow sight where the pendulum level further includes a weighted counter end. The bow sight where the target has a lower aim point and a higher kill zone, and the fiber optic pin sight is configured to be aimed at the aim point during use. The bow sight further including a range finder formed between the distance limit bar and the leveling bar. The bow sight where the pendulum level is disposed on an axel in rotational communication with the leveling member. The bow sight further including a mounting piece. The bow sight further including an adjustment housing. The bow sight where the distance limit bar is configured to be adjusted by way of the adjustment housing. The method where the distance limit bar is adjustable. The method further including providing a pendulum level disposed in the view finder. The method where the pendulum level includes a sighting end. The method where the housing further includes a leveling member. The method where the pendulum level is freely rotatable relative to the housing by way of the leveling member, and the sighting end is configured to be disposed substantially adjacent to the pin sight when in the housing is in an upright position.

In one Example, a bow sight for aiming at a target, including a housing including a mounting side including a first slot, a far side including a second slot, an upper end, a lower end, a leveling member and a view finder an elongate leveling bar disposed across the view finder and including a first end fixedly attached to the mounting side and a second end fixedly attached to the far side and a fiber optic pin sight an elongate distance limit bar disposed across the view finder above the leveling bar and including a first end adjustably mounted in the first slot and a second end adjustably mounted in the second slot and a pendulum level in rotational communication with the leveling member and including a sighting end configured to be disposed adjacent to the fiber optic pin sight when the bow sight is in an upright position.

Implementations may include one or more of the following features. The bow sight where the target has a lower aim point and a higher kill zone, and the fiber optic pin sight is configured to be aimed at the aim point during use. The bow sight further including a range finder formed between the distance limit bar and the leveling bar. The bow sight where the pendulum level is disposed on an axel in rotational communication with the leveling member. The bow sight further including a mounting piece. The bow sight further including an adjustment housing. The bow sight where the distance limit bar is configured to be adjusted by way of the adjustment housing. The method where the distance limit bar is adjustable. The method further including providing a pendulum level disposed in the view finder. The method where the pendulum level includes a sighting end. The method where the housing further includes a leveling member. The method where the pendulum level is freely rotatable relative to the housing by way of the leveling member, and the sighting end is configured to be disposed substantially adjacent to the pin sight when in the housing is in an upright position.

In one Example, A method targeting an animal having a kill zone, including providing a bow sight including a housing including a view finder and a range finder including a leveling bar disposed in the view finder and including a pin sight and a distance limit bar disposed in the view finder and targeting the animal at an aimed point below the kill zone.

Implementations may include one or more of the following features. The method where the distance limit bar is adjustable. The method further including providing a pendulum level disposed in the view finder. The method where the pendulum level includes a sighting end. The method where the housing further includes a leveling member. The method where the pendulum level is freely rotatable relative to the housing by way of the leveling member, and the sighting end is configured to be disposed substantially adjacent to the pin sight when the housing is in an upright position.

While multiple embodiments are disclosed, still other embodiments of the disclosure will become apparent to those skilled in the art from the following detailed description, which shows and describes illustrative embodiments of the disclosed apparatus, systems and methods. As will be realized, the disclosed apparatus, systems and methods are capable of modifications in various obvious aspects, all without departing from the spirit and scope of the disclosure. Accordingly, the drawings and detailed description are to be regarded as illustrative in nature and not restrictive.

DETAILED DESCRIPTION

The various embodiments disclosed or contemplated herein relate to devices, systems and methods for targeting.

Figure 1A:
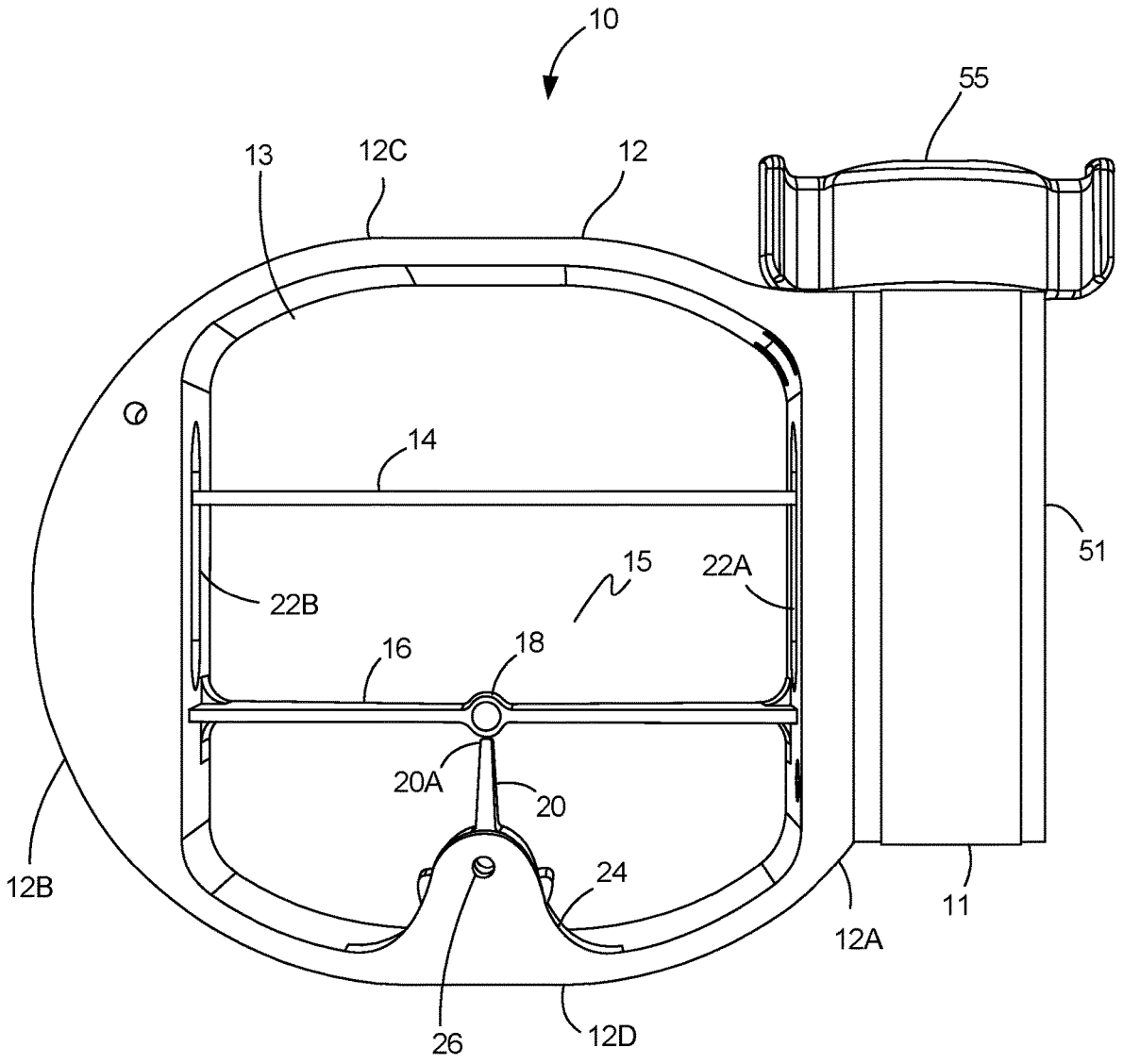
FIG. 1A is a point-of-view depiction of the sight system, according to an exemplary embodiment.
Figure 1B:
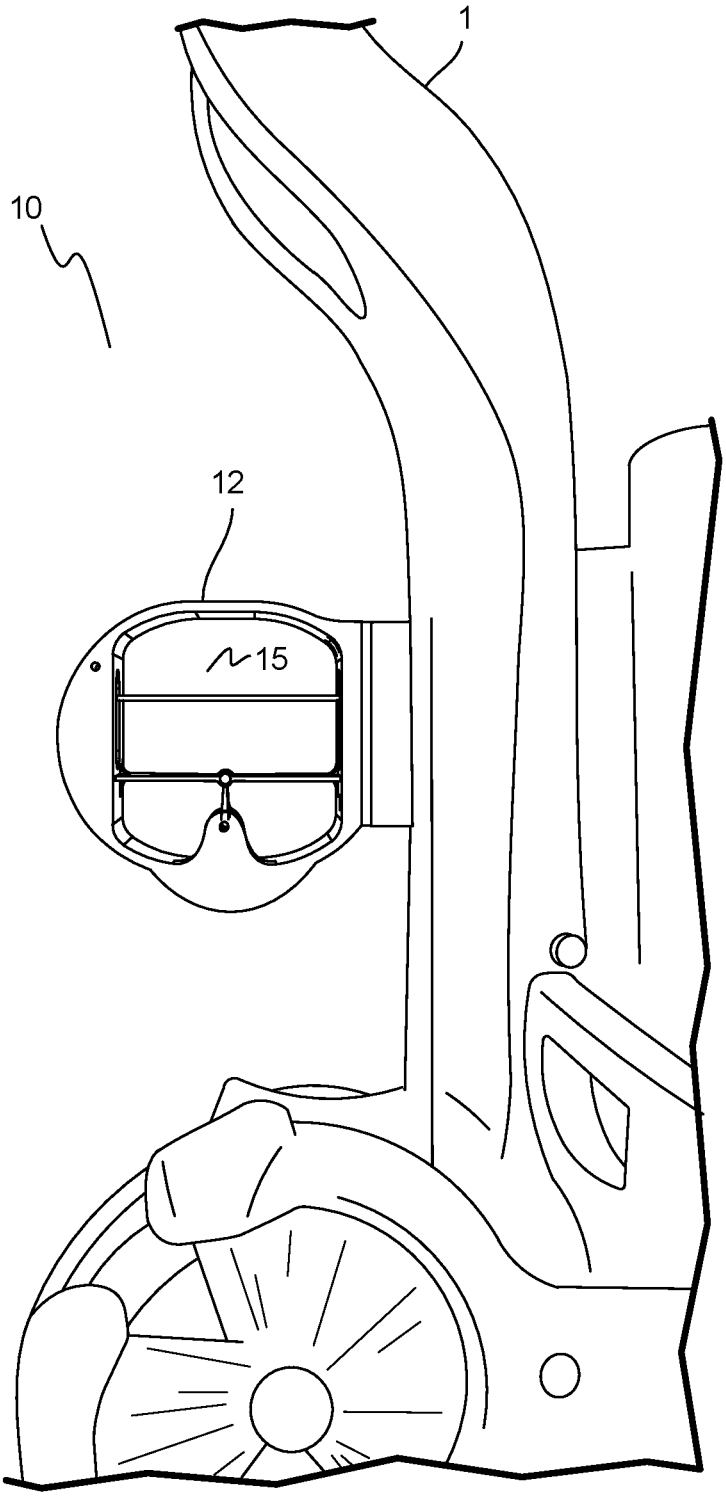
FIG. 1B is a point-of-view depiction of the sight system attached to a bow, according to an exemplary embodiment.

Turning to the figures in detail, FIGS. 1A-B show an implementations of the sight system 10 in use from the user, or hunter's point of view. In these implementations, the sight system 10 has a generally open disc-like housing 12 with a bow side, or mounting side 12A, a far side 12B, an upper end 12C, a lower end 12D and a substantially hollow central sighting view finder 13. In various implementations, the housing 12 attaches to a bow or other device (shown at 1 in FIGS. 1B-C) at the mounting side 12A and is used for aiming or sighting a target in the field of view 15 through the view finder 13. While the present description contemplates the use of the sight system 10 with a bow, it is understood that in alternate implementations the disclosed devices, systems and methods can also be adapted to be used with other hunting devices and projectile weapons, such as a variety of rifles, shotguns and the like.

Continuing with the implementation of FIG. 1A, the housing 12 has a distance limit bar 14 and a sighting bar 16 disposed across the view finder 13. It is understood that in various implementations, the distance limit bar 14 and sighting bar 16 are disposed substantially horizontally and parallel to one another, though other implementations are possible. As discussed in relation to the implementations of FIGS. 2A-C, the distance limit bar 14 and sighting bar 16 can be used as a range finder in the field of view 15.

Returning to the implementation of FIG. 1A, the distance limit bar 14 is a substantially elongate bar which is disposed substantially horizontally across the sighting view finder 13 and is adjustable relative to the housing by way of at least one adjustment opening or slot 22A, 22B disposed on the mounting side 12A and/or away side 12B, respectively. In these embodiments, the sighting bar 16 is also substantially elongate and fixedly disposed horizontally across the sighting view finder 13. It is understood that in alternate implementations, the adjustable distance limit bar 14 can be disposed closer to the lower end 12D and the sighting bar 16 disposed closer to the upper end 12C of the housing 12. It is also understood that in certain alternate embodiments, the distance limit bar 14 and sighting bar 16 need not be horizontal bars, but can instead be represented by marks which are disposed vertically from one another within the field of view of the hunter. It is further understood that the distance limit bar 14 and sighting bar 16 need not be similarly sized.

Continuing with the implementation of FIG. 1A, a pin sight 18 is disposed on the sighting bar 16, and the view finder 13 also has a leveling pendulum 20 disposed on a leveling member 24. In this implementation, the pin sight 18 is disposed at the approximate midpoint of the sighting bar 16, though other configurations would be apparent to the skilled artisan. It is understood that in certain implementations the sight 10 can be a single pin sight 18 that is adjustable and capable of being raised and lowered within the housing to accommodate for the particular species and size of animal being hunted, as described further herein.

Figure 1C:
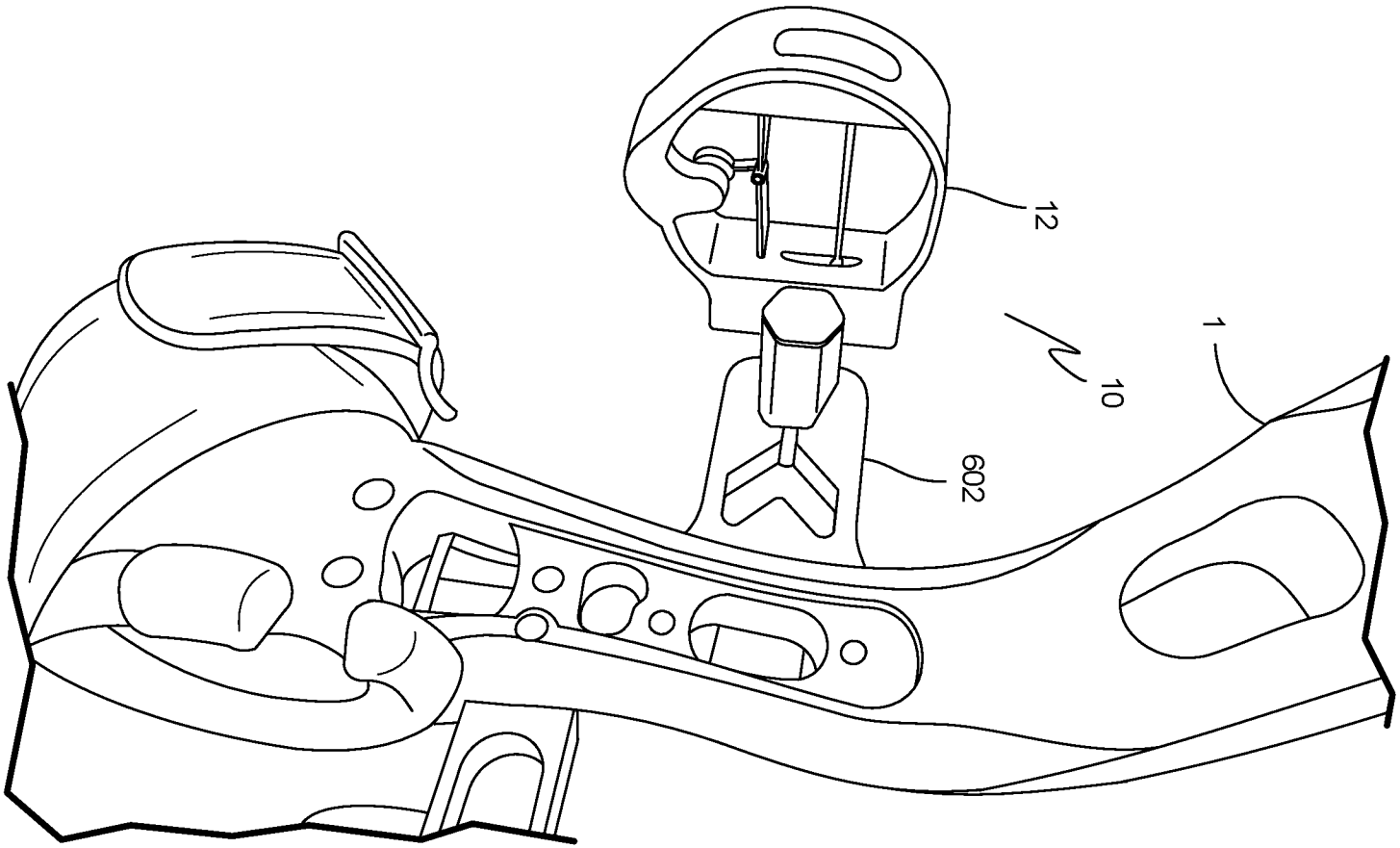
FIG. 1C is a perspective view of the embodiment of FIG. 1B.
Figure 2A:
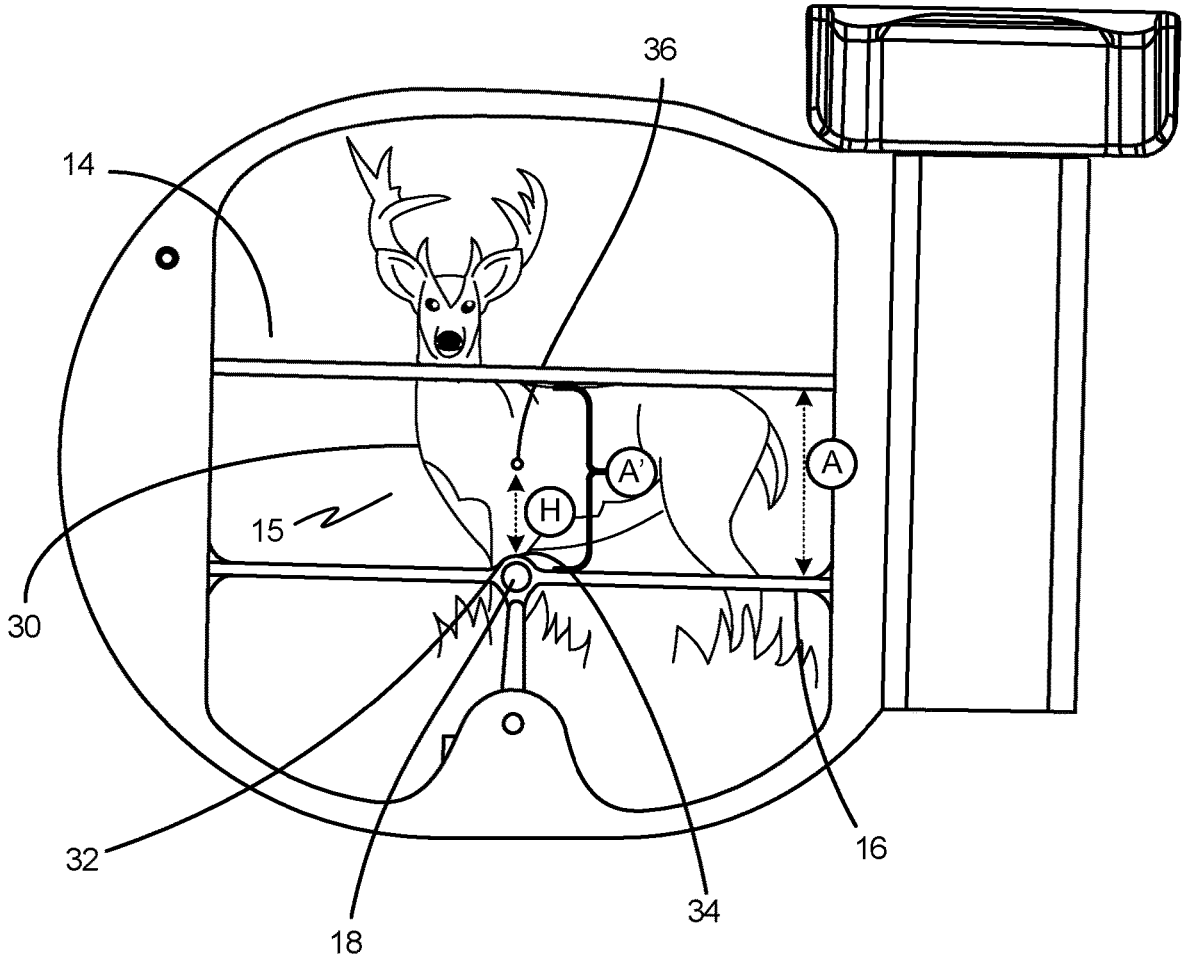
FIG. 2A is a point-of-view depiction of the sight system targeting an animal with the pin sight and using the range finder, according to an exemplary embodiment.

Exemplary implementations of the system 10 have a "range finder" (designated by the reference letter A) in the field of view 15. As is shown in the implementation of FIG. 2A, the distance limit bar 14, sighting bar 16 and pin sight 18 can be utilized to target an animal 30 such as a deer, bear, moose, elk or other game. In these implantations, the distance limit bar 14 and sighting bar 16 are configured or otherwise adapted to establish the maximum accurate distance for the bow or other hunting device (as shown in FIGS. 1B-C and 2A-C).

It is understood that when hunting, the maximum accurate distance is based on several variables, or "range factors," such as the species of the targeted animal—and therefore the typical size of that species—and the strength of the expected shot, which can depend on the kind of bow, string and arrow being used used, the skill of the hunter and other variables known in the art. By using range factors, the range finder (reference letter A) can be calibrated by adjusting the distance between the limit bar 14 and sighting bar 16. The range finder therefore allows the hunter to easily establish if the target animal 30 is within range of the bow or other hunting device.

Continuing with the implementation of FIG. 2A, the distance limit bar 14 and sighting bar 16 are configured such that the fiber optic pin sight 18 can be aimed at the breastplate, or chest 32 of the target animal, and the distance limit bar 14 will provide a visual verification to the user as to whether or not the target animal 30 is within the established maximum range of the bow based on the configuration. It is understood that in these implementations, if the overall vertical distance of the animal torso (designated by reference arrow A') is less than the height of the range finder (reference arrow A), then the animal is likely out of range of the bow, as established by the range factors. It is understood that the in-the-field of view range finder A allows the user to quickly make a determination about whether or not to fire at a target without having to move their eye from the target or make any other adjustments.

Figure 2B:
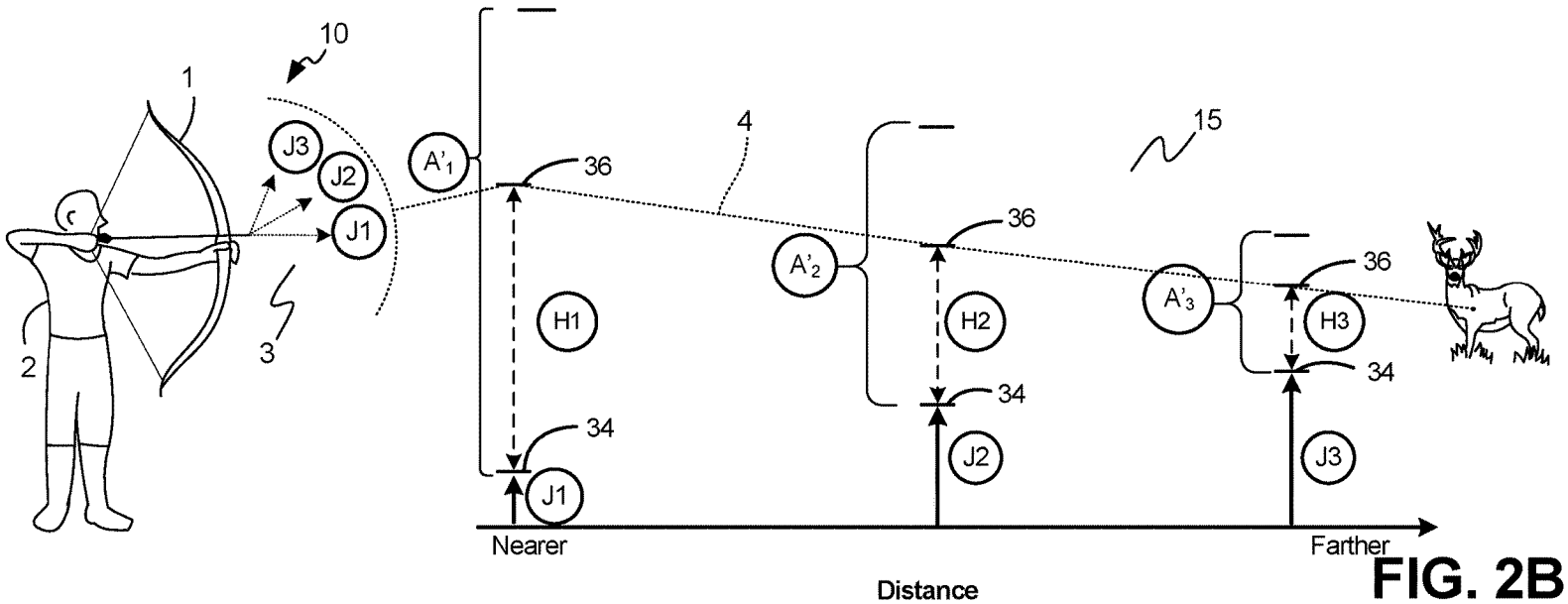
FIG. 2B is a side-view schematic showing the sight system kill zone correction at various distances, according to an exemplary embodiment.
Figure 2C:
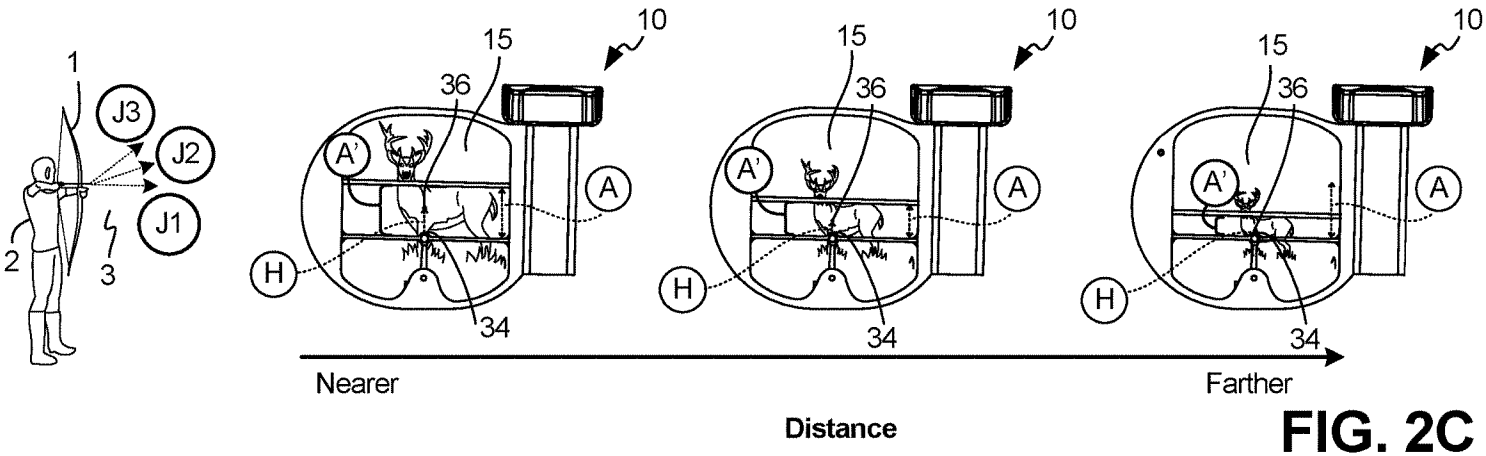
FIG. 2C is a perspective view of the embodiment of FIG. 2B.

As best shown in the implementations of FIGS. 2A-2C, the system 10 allows the user 2 to use an aim point 34 at the "bottom" of the target 30 and consistently hit the "kill zone" 36. In these implementations, the system 10 makes use of the geometry of the field of vision 15 to account for the kill zone correction over a given distance as described here. As best shown in the implementations of FIGS. 2A-C, in use, to sight the bow 1 the user 2 uses the pin sight 18 to use and aimed point 34 substantially at or near the chest 32 of the target animal 30 such that the released arrow will hit the animal 30 at the optimal location for that animal, called the "kill zone" 36. It is understood that in various implementations the kill zone 36 will vary depending on various kill zone parameters, such as the species, sex, age, geographic area and other factors about particular animal populations known to those of skill in the art.

An important aspect of these implementations of the sight system 10 is the ability to aim at the lower end—the brisket/chest 32—of the animal 30, establishing the aimed point 34. In these implementations, when the hunter aims at this lower aimed point 34, the sight system 10 is configured to release the arrow from the bow to actually hit the higher kill zone 36, located in the vicinity of the heart of the animal 30. As such, these implementations of the system 10 allow the hunter 2 to easily aim at a visually distinct, high contrast point: the edge established by the brisket/chest 32 against the background. It will be understood that the decision to release an arrow is one that must be made in seconds or fractions of a second, and that the ability to simplify and/or remove any amount of time or degree of complexity from the release decision can make the difference between a kill and a miss—"one that got away." Accordingly, aiming at the easily established, high contrast aim point 34 facilitates increased accuracy and effectiveness in the resulting shot.

As described in relation to the implementations of FIGS. 2B-C, the sight 10 utilizes the field of view 15 geometry of an object (such as the target 30) as it is moved further away in the field of view 15. In these implementations, the target 30 at a given distance can be considered a frusta relative to the view finder 13. Various implementations of the system 10 utilize these geometries to establish a correction between the aimed point 34 and the kill zone 36, referred to herein as the "kill zone correction." It is understood that as any object is moved away from an individual point of view—the view finder 13—that object appears to "contract" relative to the object's own center, as is the case with iterative frusta. Meaning that in the case of an target 30 having a lower end (the aimed point 34), a center (the kill zone 36), and an upper end, as the target 30 is successively moved further away from the view finder 13, the upper and lower ends—including the aimed point 34—will appear to the user to "contract" toward the kill zone 36. By consistently aiming at the increasingly "higher" aimed point 34, the kill zone correction is inherently applied to the user's released shot such that at any distance permitted by the range finder (described in relation to FIG. 2A), a shot released while aiming at the aimed point will "target" the kill zone 36.

As further illustrated in the implementations of FIGS. 2B-C, the perceived height A' of the target 30 in the distance decreases as the distance increases from a central point on that object. Thus, as the target 30 is moved further away from the hunter 2, the actual distance between the brisket or aiming point 34 and the kill zone 36 on the animal remains constant, but the perceived height (designated in FIGS. 2B-C by reference arrows H1, H2, and H3, respectively) appears to reduce from the point of view of the hunter. As described above, this apparent reduction is crucial for the way that the sight system 10 introduces the kill zone correction, because the hunter is actually aiming (shown generally at 3) at a "higher" point while perceiving to be aiming at the brisket in all cases. The sight system 10 achieves this correction because the hunter is aiming for the brisket aiming point 34 no matter the distance, and because the animal appears smaller in the distance, the hunter is aiming higher, thus automatically making the correction when the arrow is released (the arrow trajectory is depicted generally at 4). As is illustrated in FIG. 2B, because that distance (designated by reference arrows H1, H2 and H3) appears to reduce as the animal is further away, the sight is automatically able to correct for the distance between the hunter and the animal because the hunter is aiming at a higher point (designated by reference arrows J1, J2, and J3, respectively), and therefore releasing the arrow with a higher initial trajectory (designated generally at 4).

Accordingly, in the implementations of FIGS. 2B-C, an arrow perceived by the hunter to be released at the aimed point 34 (J1, J2, J3) will consistently arrive the higher kill zone 36—regardless of the distance—so long as the target animal 30 is within the usable range dictated by the range finder (shown at reference arrow A in FIG. 2A). It is understood that initial uses of the sight system 10 may seem counterintuitive to many hunters for this very reason. In these implementations, when the animal 30 is at a greater distance (J1, J2, J3), the user 2 must raise the aimed point 34, and therefore the sight pin 18 and bow in order to keep the bow aimed at the aimed point 34. This raising of the sight is crucial to the kill zone correction that allows the user to continue to hit the kill zone 36 regardless of the distance. Additionally, shots fired from an inclined or declined position remain consistent because the animal's torso or chest 32 is substantially cylindrical and therefore the lowest edge or horizon remains relatively constant regardless of the vertical angle of approach. It is understood that gravity will have a marginal incremental effect on each fired shot, and that in certain implementations a slight correction for gravity may be required.

Continuing with FIGS. 2B-C, the sight system 10 can be calibrated on a specific bow 1 to incorporate the kill zone correction by methods well known in the art. For example, the housing 12 can be variously and adjustably mounted on the bow as described in relation to FIG. 13. It is understood that the kill point correction varies depending upon characteristics of the animal, such as species, sex and age, though these kill zone corrections tend to be highly conserved within a particular subset of species. For example, a typical elk is 30 inches from chest to back while a deer is 18 inches. Thus, for Elk the typical kill zone 36 is about fourteen inches above the aiming point 34. For deer, the kill zone correction is about seven to nine inches. Accounting for the specified kill zone correction can be done by. By aiming at the bottom of the chest 32 and having the arrow consistently arrive at a kill zone about seven to nine inches above the aimed point 34 for deer and fourteen inches above the aimed point 34 for elk, the system 10 is highly consistent and improves hunting outcomes—for the hunter. By using known distances such as these, that housing 12 and bow 1 can be selectively calibrated by a skilled artisan.

The sight system 10 therefore achieves increased consistency by using the distance limit bar 14 and sighting bar 16 to accurately establish and correct for the distance between the hunter and the animal 30 based on the animal's known likely size. It is understood that arrows fall while traveling through the air, so in certain implementations, the hunter must adjust their aim upwards as the animal is farther afield than is permitted by the range finder. This is typically achieved by aiming "above" the target based on the hunter's own estimate of the range, which can result in inconsistency.

Figure 3:
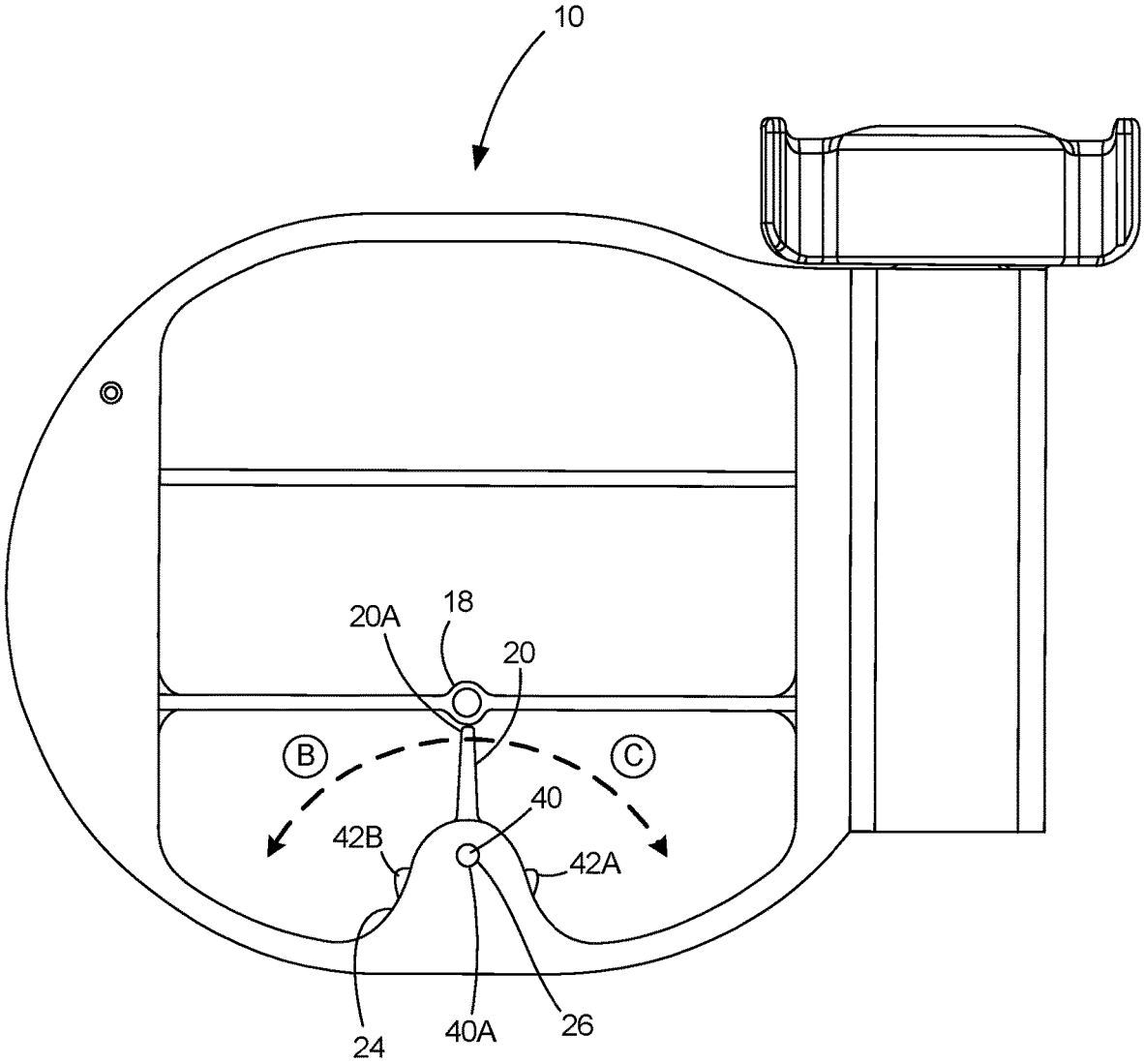
FIG. 3 is a point-of-view depiction of the sight system showing the pendulum, according to an exemplary embodiment.

As best shown in the implementation of FIG. 3, the sight 10 has an elongate leveling pendulum 20 to allow the user to quickly determine if the bow is being held in an optimal targeting position and improve accuracy. Accordingly, the pendulum 20 in these implementations helps to ensure that the bow is being held in a substantially "upright" position—an orientation that is substantially in line with the force of gravity. Further, as best shown in the implementation of FIG. 3, the pendulum 20 is disposed within the housing 12 close to the pin sight 18, so that the user does not have to divert their eyes to establish the orientation of the bow. Many prior art sights make use of a "bubble level" located at or near the bottom of the sight ring. When using these prior art approaches, the user has to glance downward from the aiming point to ensure that the bow is level, which can cause crucial delays and require re-aiming.

As best shown in the implementation of FIG. 3, the pendulum 20 has an elongate sighting end 20A configured to be substantially aligned with the pin sight 18 when the sight 10 is upright. In these implementations, the sighting end 20A is proximate to the pin sight 18, so as to be as close as possible within the user's field of view and to ensure accuracy. In various embodiments the pendulum 20 is mounted on a freely-rotating axel 40. The axel 40 being mounted so as to freely rotate in an opening 26 in the leveling member 24 at a pivot point 40A, so as to be freely rotatable about the pivot point 40A (as is indicated by reference arrows A and B) such that the sighting end 20A is always pointing in substantially the opposite direction of the force of gravity. It is understood that various embodiments can reduce or eliminate stiction with various lubricants and other materials known in the art. It is further understood that in alternate implementations, the pendulum 20 can be variously shaped.

Figure 4:
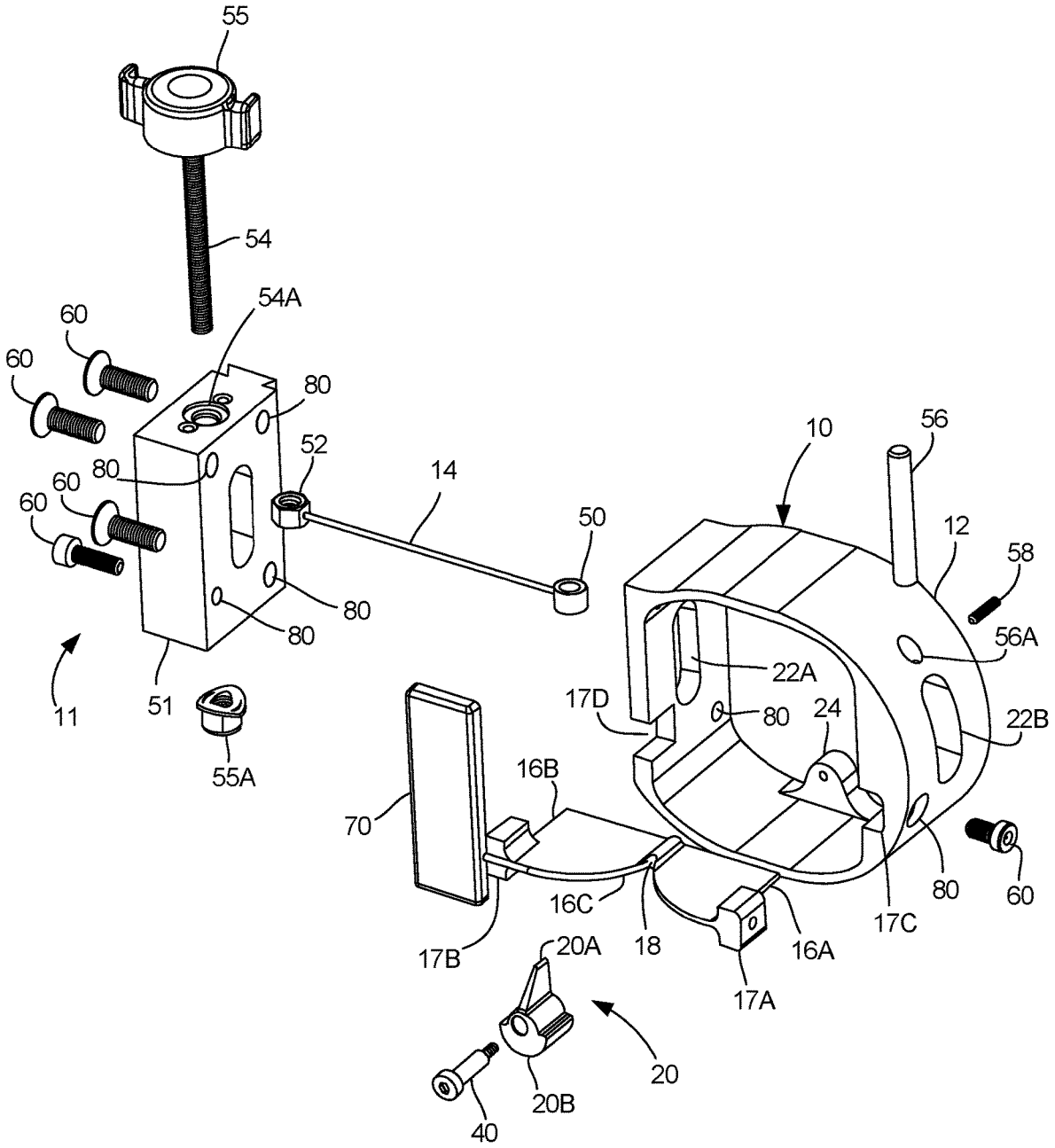
FIG. 4 is an exploded view of the sight system showing various components, according to an exemplary embodiment.
Figure 5:
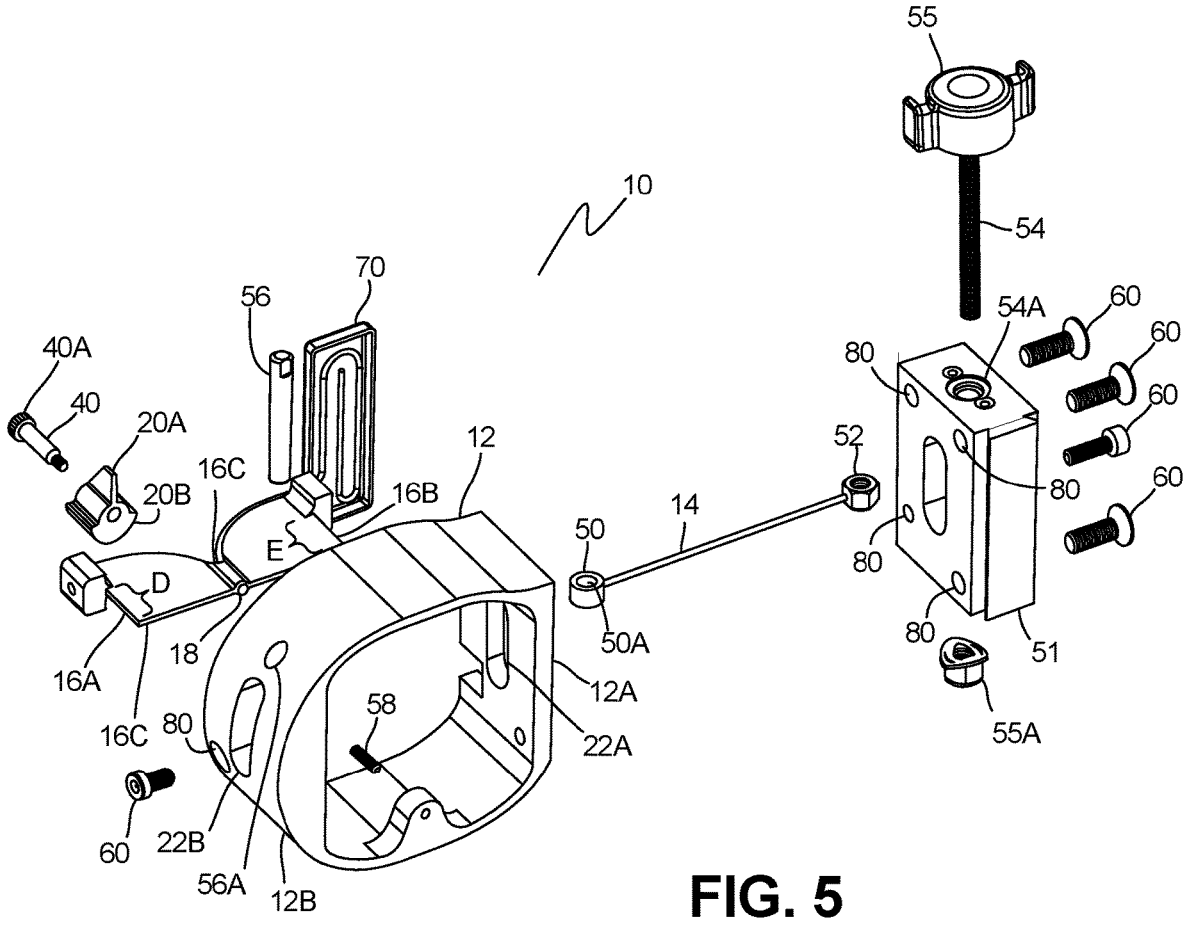
FIG. 5 is another exploded view of the sight system showing various components, according to an exemplary embodiment.

Continuing with the implementation of FIG. 3, the pendulum 20 has a weighted counter end 20B opposite the sighting end 20A, as is shown in the exploded view of FIGS. 4-5. It is understood that in alternative implementations, the counter end 20B may make use of other orientation mechanisms known in the art. It is further understood that the weighted counter end 20B of these implementations has sufficient ballast to orient the sighting end 20A substantially vertically despite various tiling movements of the bow in any combination of the X- Y- and/or Z-axis. Accordingly, in various implementations, the axel 40 and/or pivot point 40A can further comprise of a ball bearing system or other lubricant (not shown) to ensure that the pendulum 20 is freely rotatabable in response to gravity. In these embodiments, the user is thus able to quickly and easily determine if the bow is substantially upright by assessing if the sighting end 20A is substantially aligned with the pin sight 18—and the bow is therefore upright—without diverting their eyes from the target.

FIGS. 4 and 5 depict exploded views of various embodiments of the sight system 10 housing 12 and related components. In these embodiments, the housing 12, distance limit bar 14, sighting bar 16 and leveling pendulum 20 are operationally integrated as described herein. In exemplary embodiments, the system 10 has an adjustment device 11 which allows the user to adjust the vertical position of the distance limit bar 14 relative to the housing 12. In these embodiments, the distance limit bar 14 is substantially elongate and has first 50 and second 52 support portions. In the embodiment of FIGS. 4-5, the first end portion 50 has an opening 50A, which is adapted to be in slidable communication with a support structure 56 which is set inside the housing 12 by way of a support hole 56A and fixedly attached with a fastener 58, such that the distance limit bar is capable of vertical movement relative to the support structure 56 inside the slot 22A, 22B. In certain embodiments, the opening 50A is of sufficient depth so as to force the horizontal alignment of the distance limit bar 14 relative to the support structure 56, as would be apparent to one of skill in the art.

In the implementations of FIGS. 4-5, the opposite, or second end 52 has a threaded fastener, such as an internally threaded fastener such as a driven nut 52 which is in operational communication with a driving fastener, such as a driving screw 54, so as to vertically position the distance limit bar 14 within the housing, as would be apparent to one of skill in the art. In these embodiments, the driving screw 54 has an adjustment knob 55 and cap 55A at opposite ends, such that the driving screw is held in a corresponding vertical position within the housing 51 of the adjustment device 11 within a corresponding slot 22A. In these embodiments, the rotation of the adjustment knob 55 is operationally connected with the limit bar 14 by way of the driven screw 54 and driven nut 52 so as to raise or lower the limit bar 14 based on the user's needs or preferences. Further, in these embodiments, the adjustment housing 51 is fixedly attached to the sight housing 12 by way of a plurality of fasteners 60.

As is also apparent from FIGS. 4-5, in these embodiments, the elongate, planar sighting bar 16 has a first end 16A and a second end 16B and may be configured so as to have an inlet point 16C to the centrally-mounted pin sight 18. In these embodiments, a fiber optic system 70 is fixedly attached to the second end 16B of the leveling bar 16 so as to be in fiber optic communication with the pin sight 18 to project the sighted aiming point (not shown), as would be apparent to one of skill in the art. Further, in these embodiments, the ends 16A, 16B are also fixedly attached to mounting portions 17A, 17B which are correspondingly attached to the housing 12 at mounting openings 17C, 17D and held in place by way of the plurality of fasteners 60 and corresponding fastener openings 80. As is shown in FIG. 5, in certain embodiments, the mounting portions 17A, 17B do not extend to the foremost edge 16D of the leveling bar, thus leaving a space (shown at reference letters D and E). Other embodiments are possible.

Figure 6A:
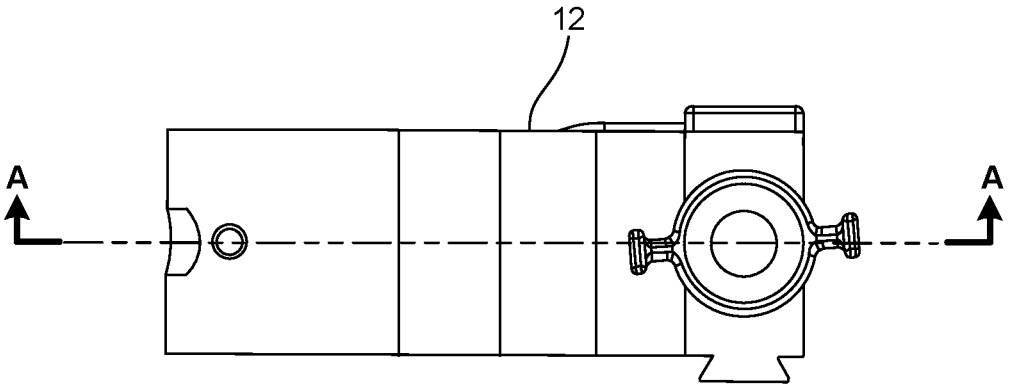
FIG. 6A is a top view of the sight system, according to an exemplary embodiment.
Figure 6B:
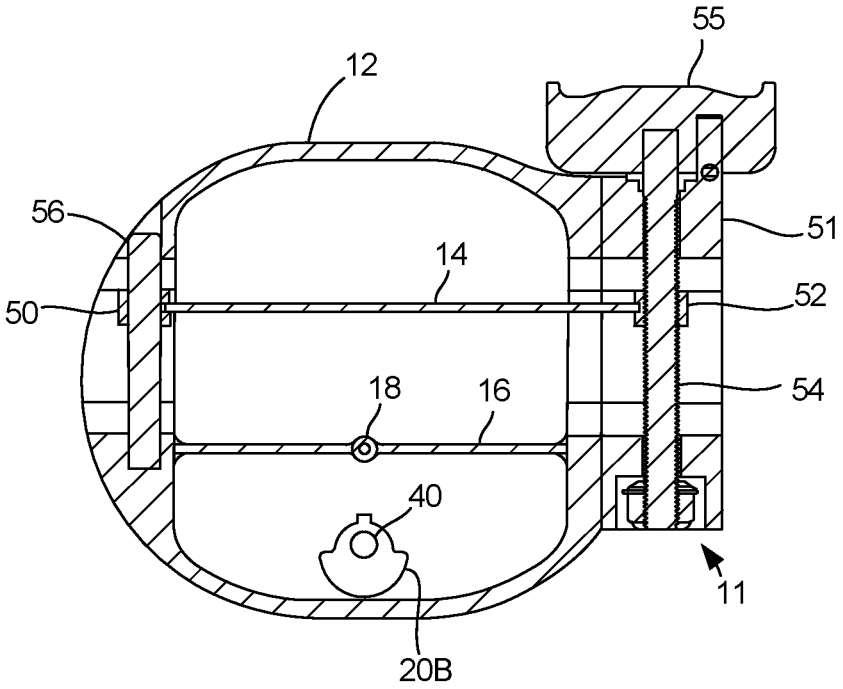
FIG. 6B is cutaway view of section A-A in FIG. 6A.
Figure 7A:
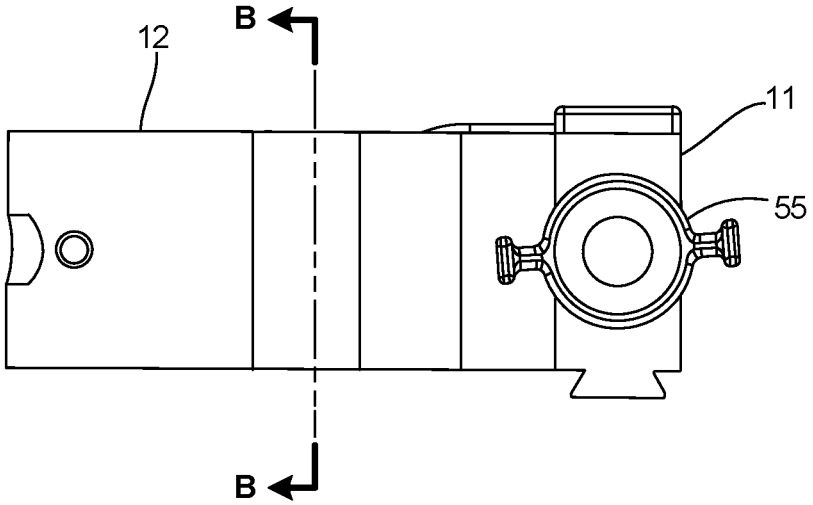
FIG. 7A is another top view of the sight system, according to an exemplary embodiment.
Figure 7B:
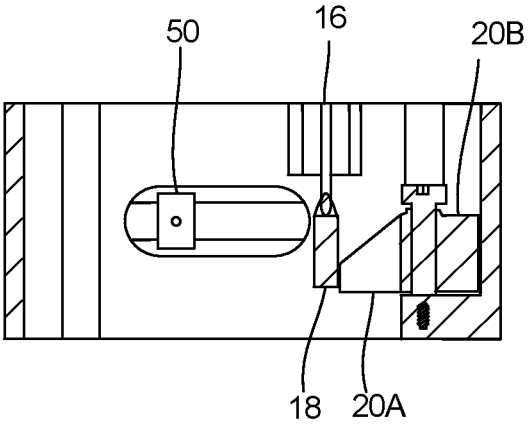
FIG. 7B is cutaway view of section B-B in FIG. 7A.

FIGS. 6A-7B depict further views of an exemplary embodiment of the sight system 10. FIG. 6A depicts a top view of the housing 12, and FIG. 6B depicts a cross sectional view of the housing at the reference line A-A. FIGS. 7A-7B depict a further cross-sectional view of the principle aspects from the view of section B-B, the workings of which are described herein in relation to FIGS. 1A-5.

Figure 8:
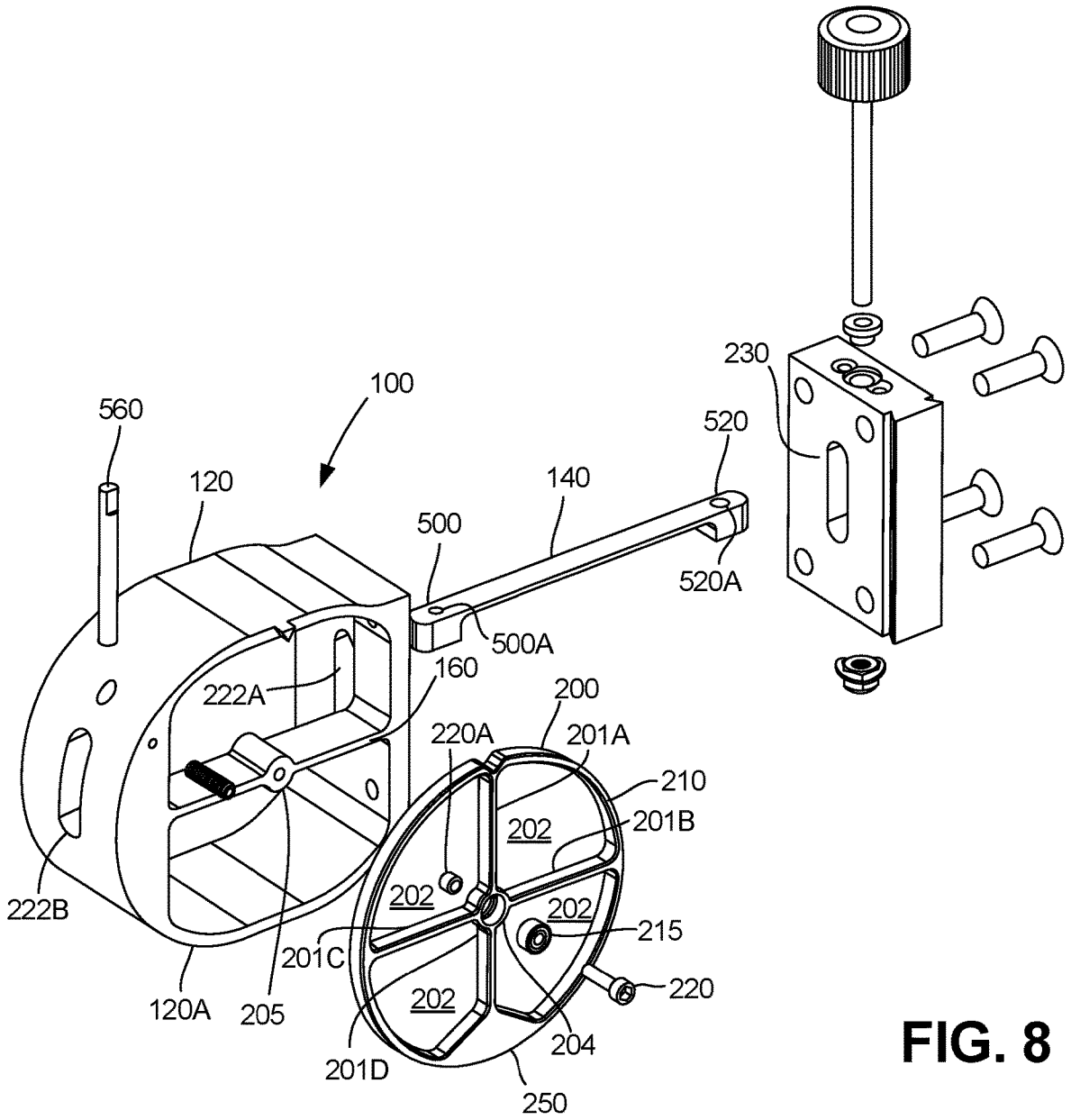
FIG. 8 is an exploded view of an alternate embodiment of the sight system with a wheel level.

An alternative embodiment of the sight 100 is depicted in FIGS. 8-9. In these embodiments, the sight 100 has a wheel level 200. In such embodiments, rather than taking the pendulum form the level 200 is comprised of a wheel having a generally planar, disc-like configuration and circumferential border 210. The wheel 200 has a plurality of internal openings 202 set between a plurality of spokes 201A, 201B, 201C, 201D, such that the wheel level 200 can be disposed substantially on the surface of the proximal 120A portion of housing 120. In these embodiments, the level 200 has a central opening disposed between the spokes such that a bearing 215 can be operationally integrated into the wheel so as to allow the free rotation of the level 200 relative to the housing 120 by being attached along an axle 220 (and washer 220A) which is coupled to the attachment point 205.

Figure 9A:
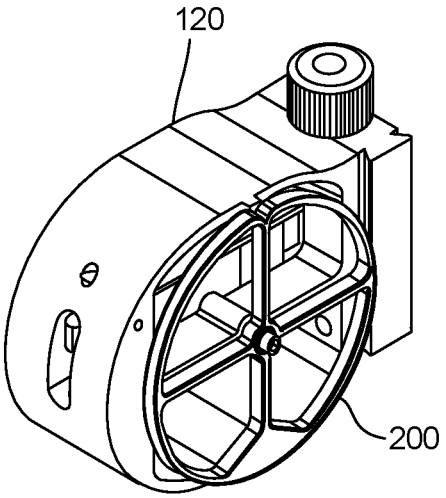
FIG. 9A is a perspective, assembled view of the embodiment of FIG. 8.
Figure 9B:
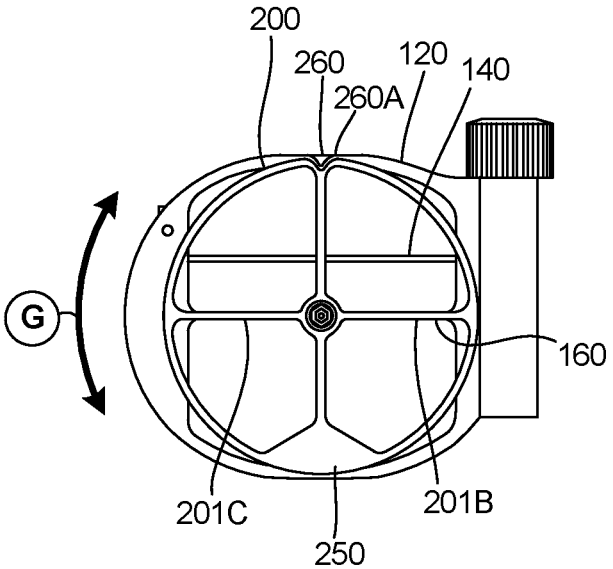
FIG. 9B is a point-of-view depiction of the embodiment of FIG. 8.
Figure 10A:
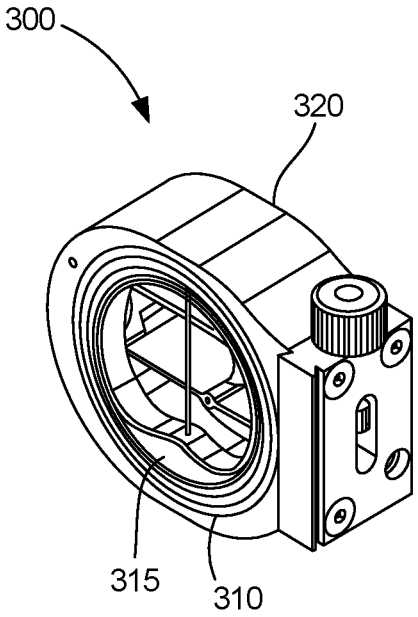
FIG. 10A is a perspective view of an alternate embodiment of the sight system having an alternate wheel level.
Figure 10B:
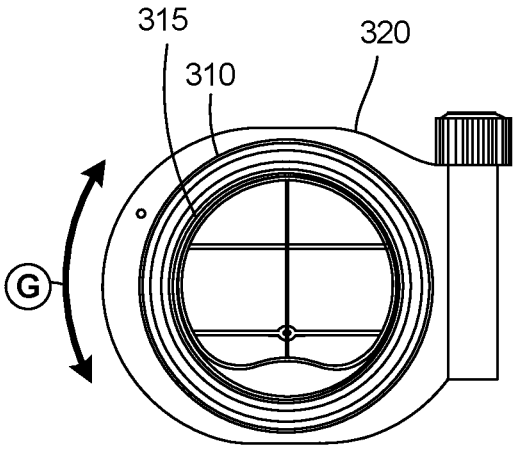
FIG. 10B is a point-of-view depiction of the embodiment of FIG. 10A.
Figure 11:
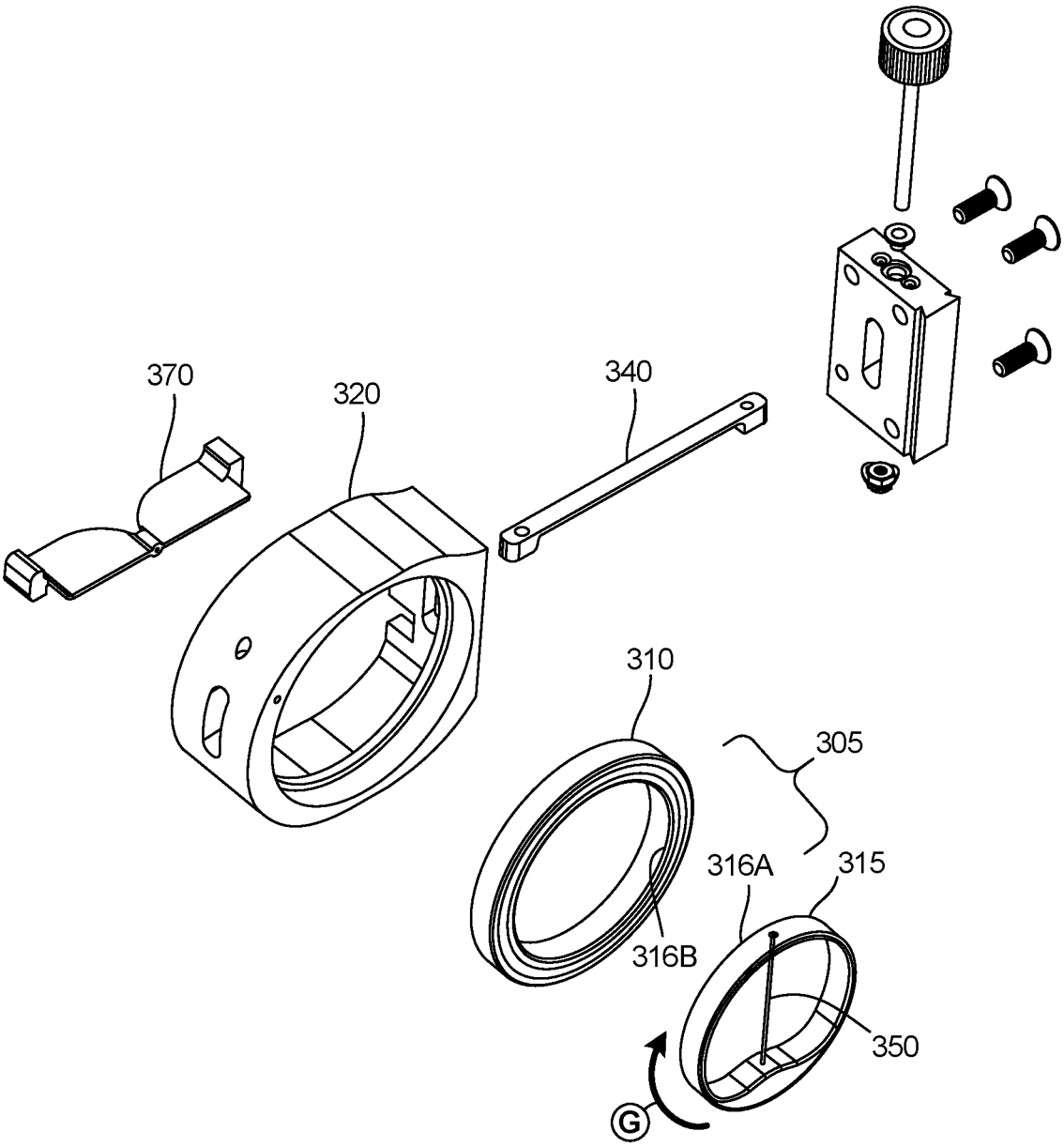
FIG. 11 is an exploded perspective view of the implementation of FIGS. 10A-B.
Figure 12:
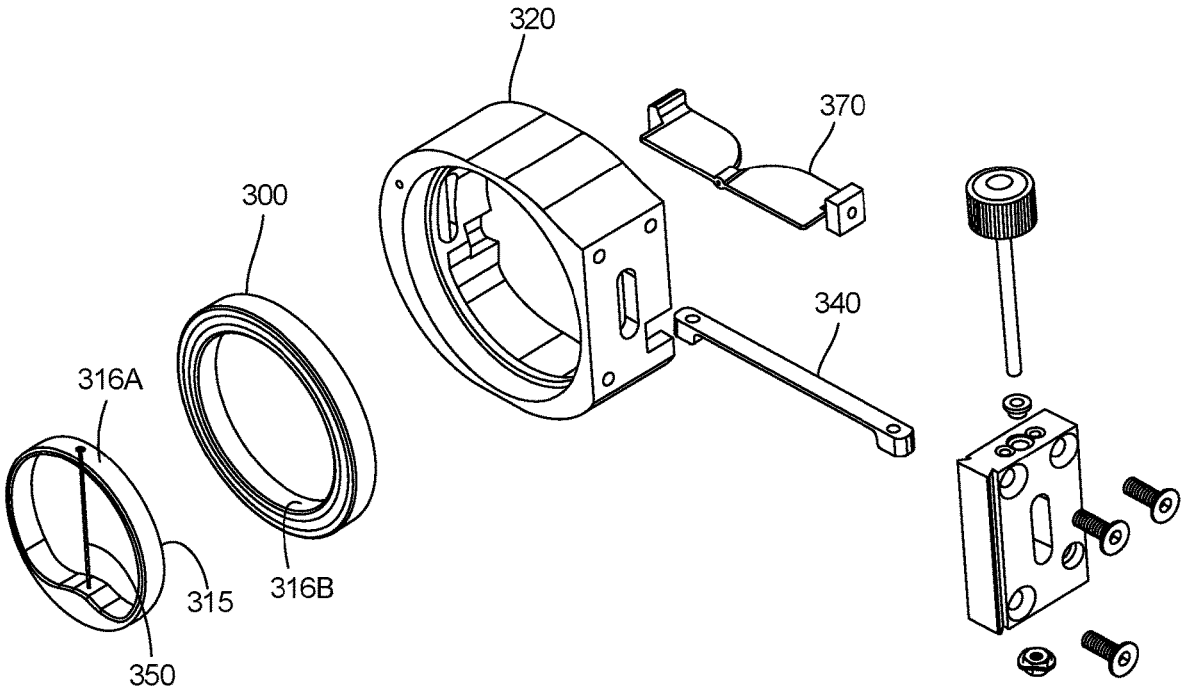
FIG. 12 is an opposite exploded perspective view of the implementation of FIG. 11.

As shown in FIGS. 9A-B, in certain embodiments, at least one of the spokes 201B, 201C is disposed within the wheel level 200 so as to be substantially aligned with the leveling bar 160. In certain embodiments, the wheel has a weighted bottom portion 250, which serves to keep the wheel level 200 generally aligned with the force of gravity, as described previously, and accordingly allows the hunter to easily determine the alignment by way of the spokes 201B, 201C which are aligned with the leveling bar 160 when the bow is in the upright position, as opposed to rotated in response to gravitational force, as indicated by reference arrow G.

Returning to FIG. 8, in certain embodiments, the limit bar 140 is a single piece bar having first 500 and second 520 ends further comprising first 500A and second 520A openings configured to be operationally coupled to the housing by way of the support structure 560 and driving screw 540 and slidably contained in the slots 222A, 222B, 230. In use, the sight 100 thereby functions in a substantially similar fashion to that which was described above in relation to FIGS. 1A-5.

A further alternate embodiment is depicted in FIGS. 10A-12. In these embodiments, the sight 300 has an alternate wheel level 305, which is comprised of a bearing assembly 310 and a wheel 315, which is assembled such that the sighting assembly may freely rotate within the bearing assembly such that the vertical bar 350 is always held substantially vertically, despite any rotation of the housing 320. In such embodiments, rather than taking the pendulum form the level 305 is comprised of a wheel 315 having a generally circular configuration and circumferential border 316A, which is set inside the bearing assembly 310 so as to be freely rotatable, as is designated by reference arrow G. The wheel 315 has a vertical bar 350 and a weighted bottom portion 360, so as to maintain the vertical orientation of the bar 350, as described previously. These embodiments may further comprise a distance limit bar 340 and sighting bar 370.

Figure 13:
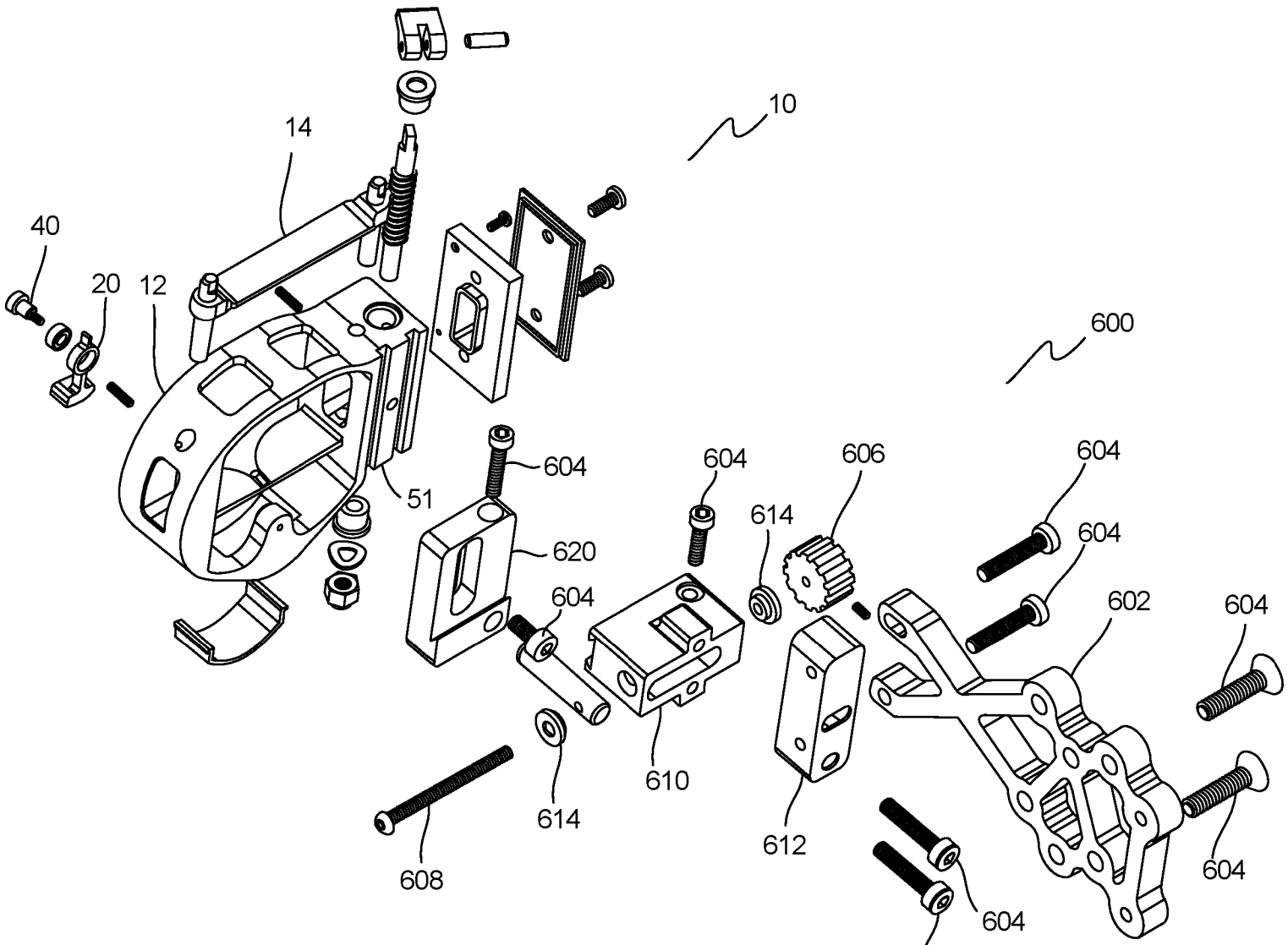
FIG. 13 is an exploded perspective view of the sight system, according to a further embodiment.

As best shown in FIG. 13, in certain implementations, the system 10 has a mounting system 600. In these implementations, the system 10 has a mounting piece 602 adapted to be affixed to a bow 1 (as shown in FIGS. 1B-C) by at least one mounting fastener 604. In these implementations, the system has an adjustment knob 606 in communication with an adjustment axel 608 disposed through a support member 610. It is understood that the adjustment knob 606 allows the user to properly alight the sight 10 with the bow 1, as would be apparent to one of skill in the art. In these implementations, a second support member 612 and washers are also provided, as is a third support 620 in operable communication with the mounting piece 602 and housing 12. It is understood that many alternate implementations are possible.

Figure 14:
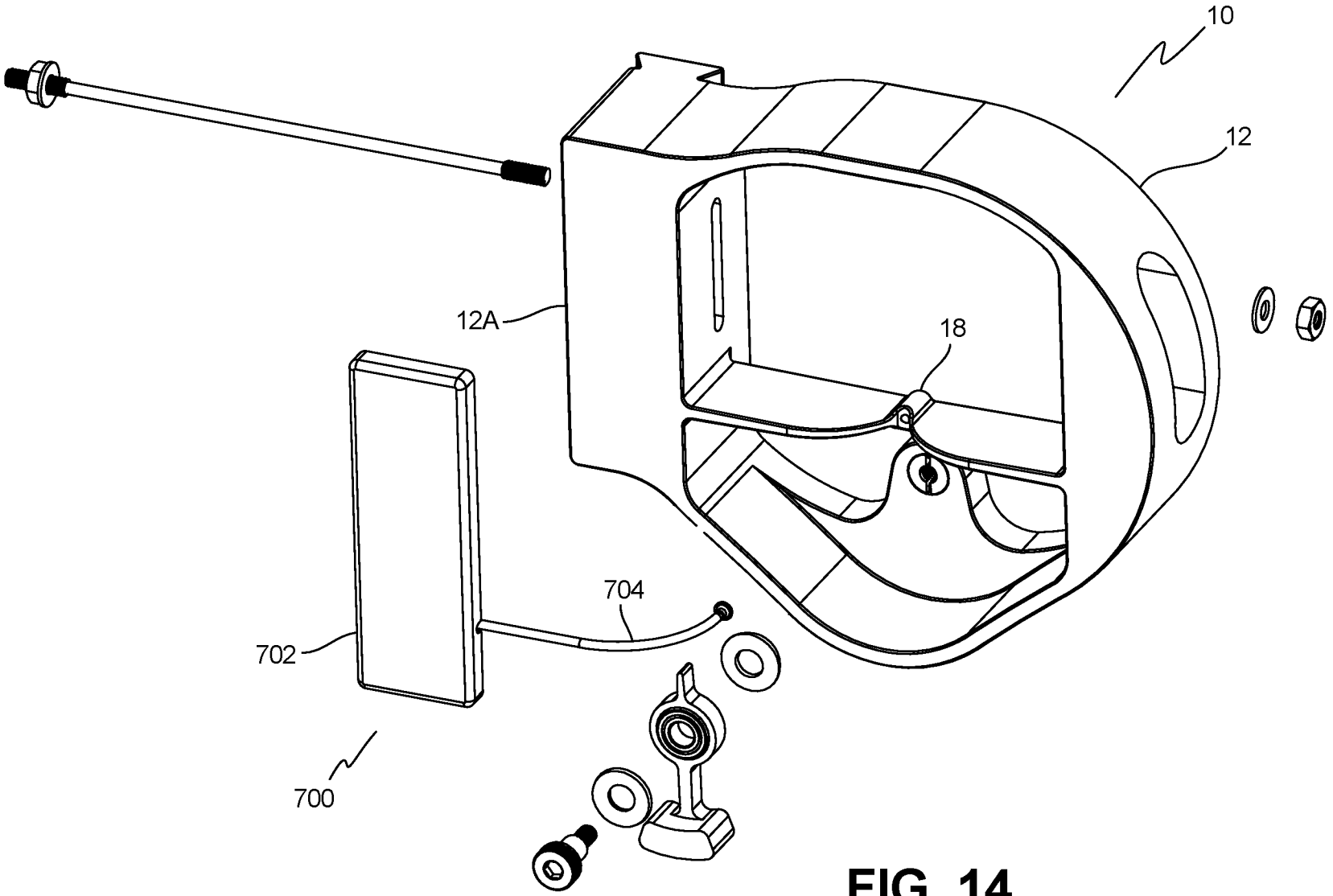
FIG. 14 is an exploded perspective view of the sight system, showing one fiber optic implementation.
Figure 15:
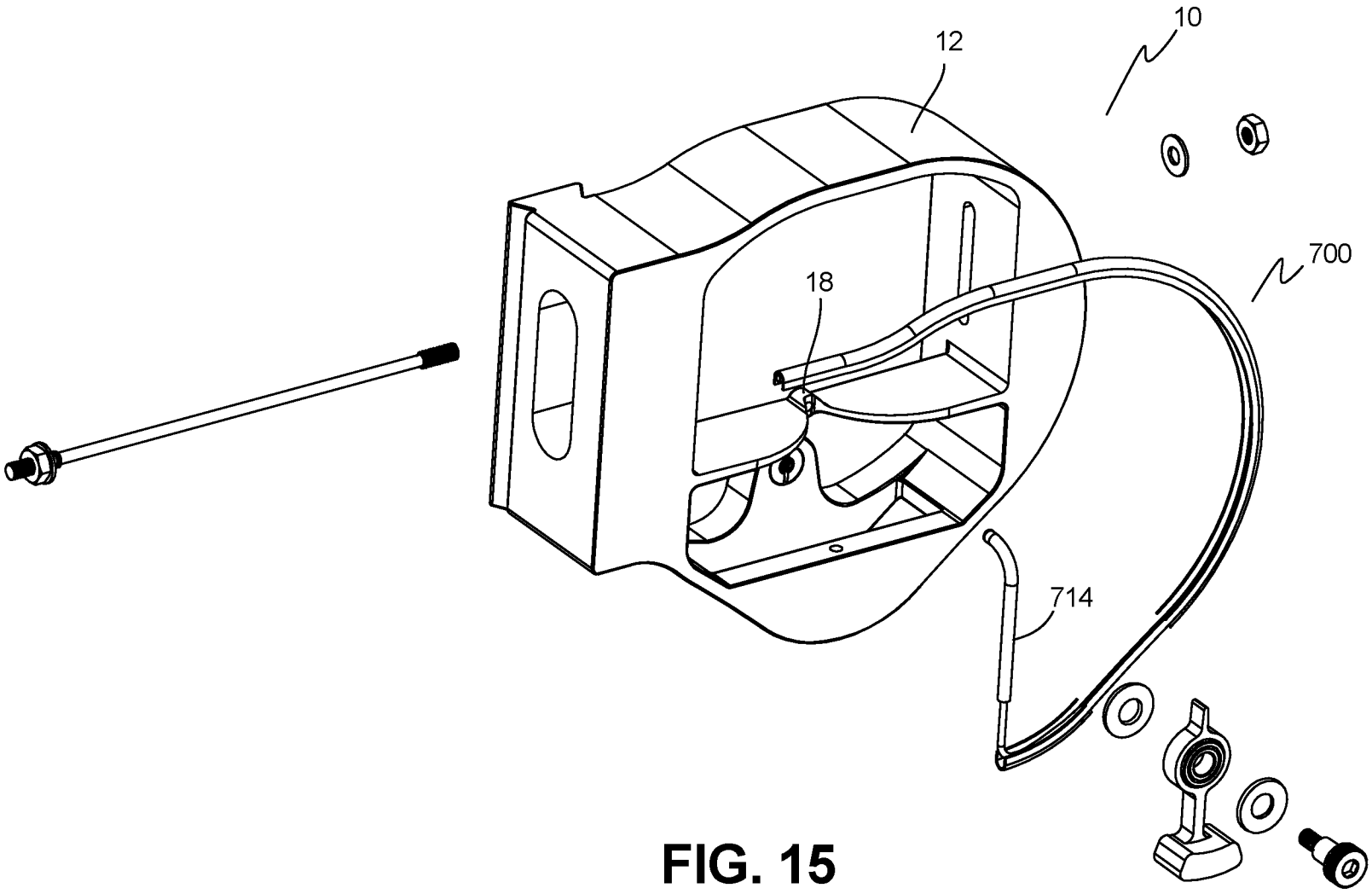
FIG. 15 is an exploded perspective view of the sight system, showing an alternate fiber optic implementation.

As is shown in the implementations of FIGS. 14-15, the system 10 can have several variations of the fiber optic leveling component, or "peep sight" 700. In these implementations, the system 10 has a fiber optic system 702 that is in optical communication with the pin sight 18. As best shown in FIG. 14, the peep sight 700 has an elongate fiber optic cable 704 extending from the fiber optic system 702 which is in optical communication with the pin sight 18. In this implementation, the fiber optic system 702 is configured to be housed in the far side 12B and the fiber optic cable 704 is disposed horizontally across the leveling bar 16 to the pin sight 18. In the alternate implementation of FIG. 15, the peep sight 700 has a longer, circumferential fiber optic cable 714. It is understood that various fiber optic lengths are advantageous in certain circumstances, and that in alternate embodiments further distances can be housed within the housing 12.

Although the disclosure has been described with reference to preferred embodiments, persons skilled in the art will recognize that changes may be made in form and detail without departing from the spirit and scope of the disclosed apparatus, systems and methods.

What is claimed is:

1. A sight, comprising:
- a. a housing;
- b. a pendulum level comprising:
  - i. a pendulum comprising:
    - a. a sighting end and
    - b. a weighted counter end opposite the sighting end and
  - ii. an axle, the axle intermediate of the sighting end and the weighted counter end; and
- c. a pin sight, wherein:
- d. the pendulum level is freely rotatable relative to the housing in response to gravity and
- e. the sighting end is substantially adjacent to the pin sight when the sight is in an upright position.

2. The sight of claim 1, wherein the sighted end maintains a substantially vertical orientation in response to tilt.

3. The sight of claim 2, wherein the housing further comprises a leveling member and the pendulum level is operatively engaged with the leveling member.

4. The sight of claim 3, wherein the axle is mounted such as to freely rotate within an opening in the leveling member.

5. The sight of claim 4, wherein the axle further comprises a ball bearing system.

6. The sight of claim 5, wherein the pin sight is a fiber optic pin sight.

7. A sight comprising:
- a. a housing;
- b. a range finder comprising:
  - i. a first bar disposed substantially horizontally across a view finder and
  - ii. a second bar substantially parallel to the first bar; and c. a wheel level comprising a disc, the disc comprising at least one spoke and the at least one spoke extending across the disc, wherein the wheel level is operatively engaged with the housing such that the wheel level is freely rotatable relative to the housing.

8. The sight of claim 7, further comprising a pin sight disposed on the second bar.

9. The sight of claim 7, wherein the first bar and second bar are adjustable.

10. The sight of claim 7, wherein the first bar and second bar are calibrated by at least one range factor defined by a target animal.

11. The sight of claim 10, wherein the at least one range factor is at least one of: targeted animal species, targeted animal size, and targeted animal sex.

12. The sight of claim 7, wherein the wheel level is operatively engaged with the housing via a bearing assembly.

13. The sight of claim 12, wherein the wheel level further comprises a weighted bottom portion.

14. A sight, comprising:

a. a housing, comprising a first side and a second side;

b. a slot disposed within the first side of the housing;

c. a distance limit bar comprising a first end and a second end, the first end adjustably mounted within the slot; and d. a sighting bar substantially parallel to the distance limit bar, the sighting bar fixedly attached to the first side and the second side of the housing;

e. a pin sight disposed within the sighting bar, wherein:

f. the distance limit bar and the sighting bar form a range finder; and g. the range finder is calibrated by at least one range factor to establish maximum accurate distance.

15. The sight of claim 14, wherein the at least one range factor includes is selected from the group consisting of: target animal species, target animal sex, target animal size, shot strength, bow type, string type, arrow type, and user input.

16. The sight of claim 15, further comprising a wheel level.

17. The sight of claim 15, further comprising a pendulum level.

18. The sight of claim 17, wherein the pendulum level comprises a pendulum the pendulum comprising:

a. an elongate sighting end; and b. a weighted counter end opposite the elongate sighting end, wherein the elongate sighting end is substantially adjacent to the pin sight when the sight is in an upright position.

19. The sight of claim 18, wherein the pendulum level is mounted on a freely-rotating axle.

20. The sight of claim 19, wherein the pendulum level is freely rotatable about a pivot point in response to gravity.

* * * * *